US007624886B2

(12) United States Patent
Huang

(10) Patent No.: US 7,624,886 B2
(45) Date of Patent: Dec. 1, 2009

(54) COLLAPSIBLE HINGED CARRIER WITH STRAP

(76) Inventor: Sunny E. L. Huang, 786 Via Monte Video, Claremont, CA (US) 91711

( * ) Notice: Subject to any disclaimer, the term of this patent is extended or adjusted under 35 U.S.C. 154(b) by 825 days.

(21) Appl. No.: 11/358,556

(22) Filed: Feb. 21, 2006

(65) Prior Publication Data

US 2006/0201849 A1 Sep. 14, 2006

Related U.S. Application Data

(60) Provisional application No. 60/659,701, filed on Mar. 8, 2005.

(51) Int. Cl.
*B65D 25/04* (2006.01)

(52) U.S. Cl. ..... 220/6; 220/507; 220/529

(58) Field of Classification Search ..... 206/200, 206/143, 144, 147, 170, 171, 172, 192; 220/23.83, 220/23.86, 6, 529, 528, 507, DIG. 15
See application file for complete search history.

(56) References Cited

U.S. PATENT DOCUMENTS 4,299,324 A 11/1981 Dickens
D294,083 S 2/1988 Collins
5,040,672 A 8/1991 DeMaio et al.
5,538,131 A * 7/1996 Harrelson ..... 206/162
5,695,051 A * 12/1997 Hart ..... 206/198
5,772,066 A * 6/1998 Reynolds ..... 220/694
6,352,167 B1 * 3/2002 Yu ..... 220/522
6,802,802 B2 10/2004 Woog

* cited by examiner

*Primary Examiner*—Stephen Castellano
(74) *Attorney, Agent, or Firm*—Paul M. Denk

(57) ABSTRACT

A hand held device has compartments and collapses for storage during periods of non-usage. The carrier has two trapezoidal shaped wings, hingedly connected upon the taller end. Hook and loop fasteners and a strap through handles temporarily secure the wings together. Each wing has two removable dividers forming compartments and collapses as its sides fold inwards. The present invention provides pockets, a detachable strap, and dividers. The carrier also has fabric covered panels with piping upon the edges, open mesh and elasticized pockets, and feet upon the bottom of the wings. The carrier transports beverages, tools, and parts among other things that may require compartments.

10 Claims, 4 Drawing Sheets

COLLAPSIBLE HINGED CARRIER WITH STRAP

CROSS REFERENCE TO RELATED APPLICATION

This non-provisional patent application is related to the provisional application for patent having Ser. No. 60/659,701, which was filed on Mar. 8, 2005, and has the same inventor.

BACKGROUND OF THE INVENTION

This invention relates generally to luggage and more specifically to open compartmentalized totes.

When playing, people often have picnics or bring refreshments to an event. Sometimes, people pack a basket for a picnic or event. The basket contains the food, beverages, and serving equipment for two or more people. For more spontaneous events, people place refreshments in a box or smaller carrier. The small carriers contain one or more bins for foodstuffs and beverages. Some small carriers are similar to backpacks or suitcases. The small carriers surround the refreshments and permit a person to carry the refreshments. A person accesses the refreshments by opening the carrier.

When working, people use tools in many locations for many purposes. In some projects, people use a group of tools at one location then move the tools to another nearby location. To save time and effort, people carry regularly used tools in a tote. The tote has an open top with a centered handle and compartments. The handle often extends above the compartments. The tote carries the tools, protects the tools from the ground, and contains the tools.

Totes also see use in vehicles where totes store items. The tote can have an elastic strap at the top of a bag for receiving trash. The tote may also contain vehicle tools, a fire extinguisher, or warning triangle and occupy part of the trunk. Totes provided additional ways to store items beyond the pockets and shelves provided by the vehicle manufacturer.

DESCRIPTION OF THE PRIOR ART

Various types of containers, totes, and luggage have appeared in the prior art over the years. For example, the patent to Dickens, U.S. Pat. No. 4,299,324, discloses sidewalls that fold inwards. The patent to DeMaio et al., U.S. Pat. No. 5,040,672 shows a six compartment beverage carrier of paperboard. The patent to Woog, U.S. Pat. No. 6,802,802 discloses a carrier with a top panel having holes for beverages. And, the patent to Collins, No. Des. 294,083 shows a three pocket bag with a fold-over flap. The home improvement and contractor supply houses carry totes of various configurations to hold hand tools and building materials for ready use by contractors and homeowners.

SUMMARY OF THE INVENTION

This invention generally defines a device with compartments that collapses for storage during periods of non-usage. The carrier has two wings of trapezoidal shape when viewed from the side. The wings are hingedly connected upon the taller side. A releasable fastener, such as a hook and loop fastener, on the lower end and a strap through hand holes temporarily secure the wings. Each wing has two removable dividers forming compartments and collapses as its walls fold inwards. The present invention provides pockets, a detachable strap, and dividers. Components of the carrier secure with hook and loop fasteners. The carrier transports beverages, tools, and parts among other things that may require compartments.

The present invention also includes semi-rigid panels covered in fabric with piping upon the edges, open mesh and elasticized pockets, feet upon the bottom of the halves, and a carrying strap for the shoulder.

Therefore, the principal object of this invention is to provide a folding carrier having compartments.

Another object of this invention is to provide construction that allows for collapsing the carrier.

Still another object of this invention is to provide two or more compartments of varying size in each half of the carrier.

And another object of this invention is to provide a stiffened handle for grasping the carrier and securing the halves.

These and other objects may become more apparent to those skilled in the art upon review of the summary of the invention as provided herein, and upon undertaking a study of the description of the preferred embodiment in view of the drawings.

BRIEF DESCRIPTION OF THE DRAWINGS

In referring to the drawings.

Corresponding reference numerals will be used throughout the several figures of the drawings.

DESCRIPTION OF THE PREFERRED EMBODIMENT

Figure 1:
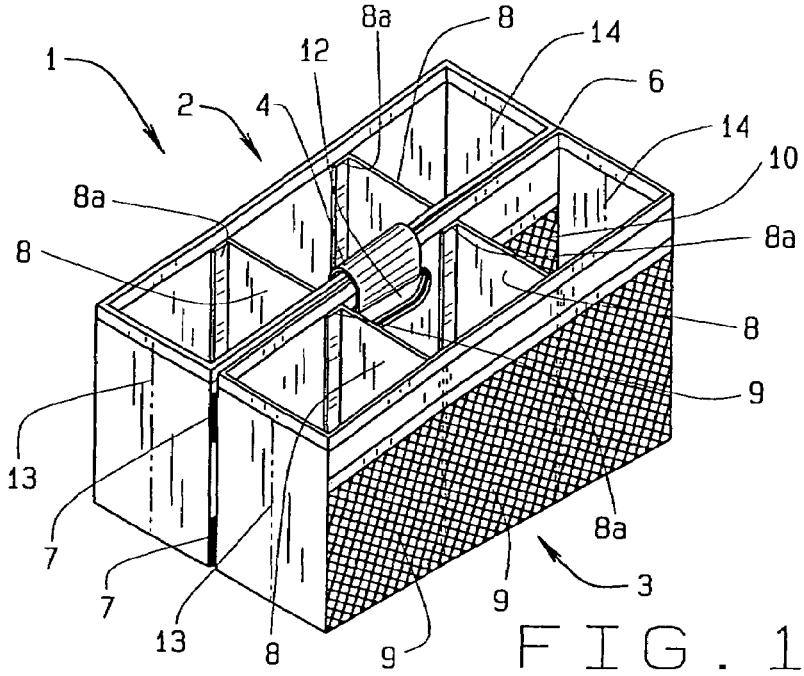
FIG. 1 shows an isometric view of the preferred embodiment of the carrier of the present invention.

In referring to FIG. 1 of the drawings, the concept of this invention is readily disclosed as a collapsible hinged carrier 1. It includes, as depicted therein, two wings commonly hinged 6 upon one end and temporarily secured upon the opposite end 7. The wings 2, 3 have a generally trapezoidal shape when viewed from the side. Each wing 2, 3 has two or more compartments formed by one or more dividers 8 having flaps 8*a* that connect to the inner and outer walls of the wing, preferably by hook and loop fasteners.

The right wing has three pockets 9 upon the outer wall 3*d* for storage of various items. The pockets 9 attach to the outer wall 3*d* where the matching hook and loop fastener joins the outer wall 3*d* for attaching the dividers 8. In the preferred embodiment, the pockets 9 have an open mesh and an elastic rim to add items into storage and easily view them. The dividers 8 form the interior of the right wing 3 into compartments for storage of other items. The dividers 8 have a generally rectangular shape with two longitudinal edges having flaps 8*a*. The flaps 8*a* fold generally perpendicular to the dividers 8 and carry a piece of hook and loop fastener for attaching to the fasteners upon the inner 3*e* and outer walls 3*d*. The right wing 3 has its shorter portion towards the front of the present invention 1. The front has a vertical fold line 13 for collapsing the right wing 3 upon removal of the dividers 8. In the vicinity of the central compartment, the inner wall 3*e* of the right wing 3 has a hand hole 12 generally in the upper third of the inner wall 3*e*. A strap 4 passes through the hand holes 12 of the inner walls 2*e*, 3*e* for both the left 2 and right wings 3. The strap 4 continues over the inner walls 2*e*, 3*e* and forms a comfortable hand grip for carrying the invention 1 when loaded. The third compartment, higher in height than the first compartment, has a pocket 10 joined to the inner wall 3*e*. As with pockets 9 upon the outer wall 3*d*, this pocket 10 has an open mesh construction with an elastic rim of less height than the outer pockets 9.

The left wing 2 joins to the right wing 3 along the hinge or major fold line 6 common on the higher ends 2*c*, 3*c* of both wings 2, 3. The left wing 2 like the right wing 3 has dividers 8 that form two or more compartments. Rectangular dividers 8 with longitudinal flap 8*a* secure to the inner 2*e* and outer walls 2*d* using complementary hook and loop fasteners. The central portion of the left wing 2 has a hand hole 12 on the inner wall 2*e*. This hand hole communicates with the hand hole on the right wing 3 and admits the strap 4. This hand hole 12 is located in the upper third of the inner wall 2*e*. The first compartment of the left wing 2 adjacent to the front has a pocket 11 upon the inner wall 2*e*. This pocket 11 like the others has an open mesh with an elastic rim. Unlike the other pockets, this first left wing inner pocket 11 is divided into three upright sections for storage of narrow items.

Figure 2:
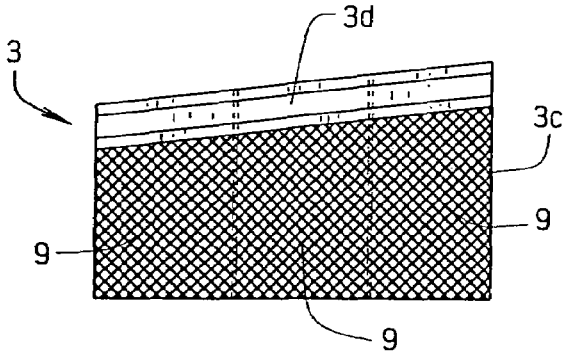
FIG. 2 shows a right side view of the preferred embodiment of the present invention.

Turning to FIG. 2, the right side of the present invention 1 has the right wing 3 shown by the lower elevation to the left of the drawing. The right wing 3 has a generally trapezoidal shape and two or more compartments as previously described. Upon the outer wall 3*e* of the right wing 3, three upright pockets 9 attach. The pockets 9 have an elastic rim towards the top 3*a* and a sewn connection upon the remaining three sides to the right wing 3. The pockets 9 have an open mesh material for ventilation and display of contents stored within.

Figure 3:
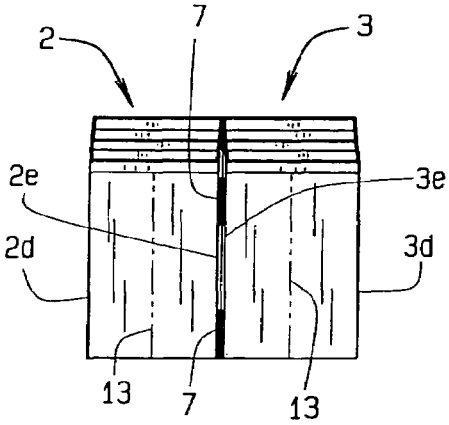
FIG. 3 provides a front view of the carrier where the wings attach temporarily.

FIG. 3 shows the front of the invention 1 with the wings 2,3 closed and together. Here the right wing 3 and the left wing 2 have their lower elevations adjacent and the right wing 3 and the left wing 2 connect by releasable fasteners 7. In the preferred embodiment, hook and loop fasteners connect the two wings. Each wing 2, 3 has a vertical fold line 13. The generally centered fold line 13 allows the walls 2*e*, 3*e* of the wings 2, 3 to collapse inward for storing the carrier 1 in a smaller volume.

Figure 4:
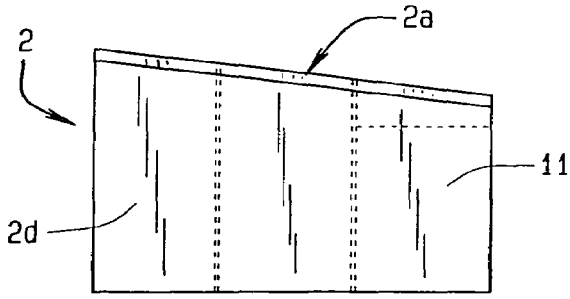
FIG. 4 shows a left side view of the preferred embodiment of the present invention.

Then FIG. 4 illustrates the left wing 2 of the collapsible carrier 1 shown by the end 2*c* to the left of the drawing. The left wing 2 also has a generally trapezoidal shape with three internal compartments to match the right wing 3. Upon the inside of the left wing 2, the first compartment at the lower elevation has a pocket 11, shown in shadow upon the drawing. As before, the pocket 11 has an elastic rim and three upright portions sewn upon the inner wall 3*e* of the left wing 2.

Figure 5:
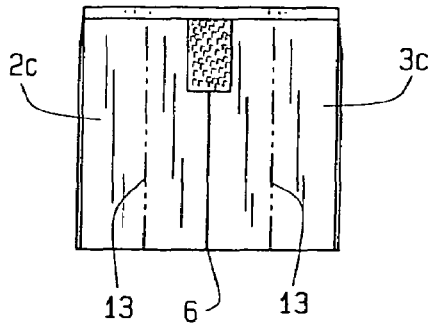
FIG. 5 provides a rear view of the carrier where the wings rotate about the major fold line.

After describing the wings, FIG. 5 shows where the left wing 2 and the right wing 3 hingedly connect at a common fold line or major fold 6 upon the higher ends 2*c* 3*c*. The left wing 2 and the right wing 3 share a common piece of material with the upright major fold 6 generally centered in the material and in the center of the invention 1. Upon releasing the fasteners and the strap 4, the left wing 2 and the right wing 3 unfold along the major fold 6. As upon the front or lower elevation, the left wing 2 and the right wings 3 have fold lines 13 generally centered in the rear or higher ends 2*c*, 3*c*. The fold lines 13 allow the left wing 2 and the right wing 3 to collapse and the carrier 1 to occupy less volume.

Figure 6:
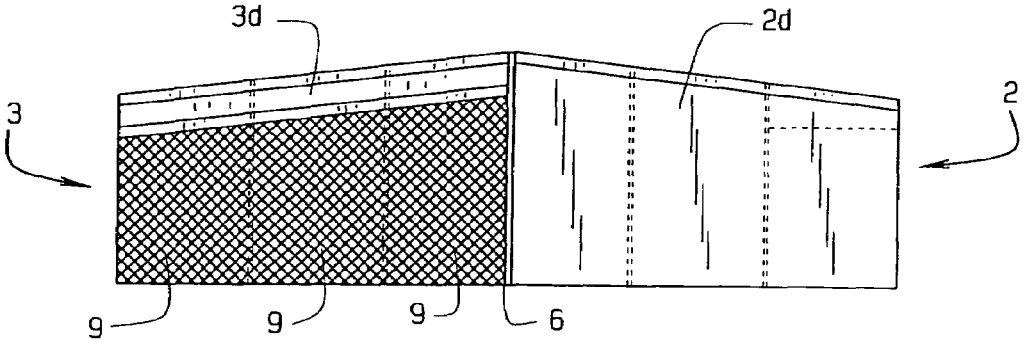
FIG. 6 illustrates a side view of the carrier with both of the wings unfolded and exterior of the right side visible.

Once the left wing 2 and the right wing 3 open along the major fold 6 in FIG. 6, the right wing 3 appears with exterior pockets 9 towards the left of this drawing and the left wing 2 has a generally smooth exterior 2*d* towards the right of this drawing. The ends 2*c*, 3*c* of both wings 2, 3 abut in the center of the invention 1 while the lower elevations are opposite. Both wings 2, 3 have two or more compartments within them established by dividers 8 attached to the walls 2*d*, 2*e*, 3*d*, 3*e* of the wings 2, 3.

Figure 7:
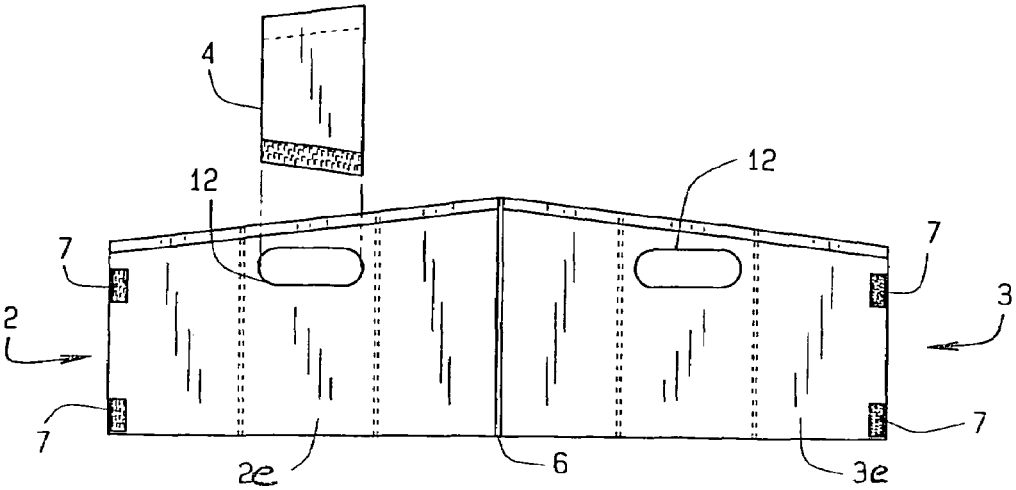
FIG. 7 describes another side view of the carrier with unfolded wings showing the interior walls.
Figure 9:
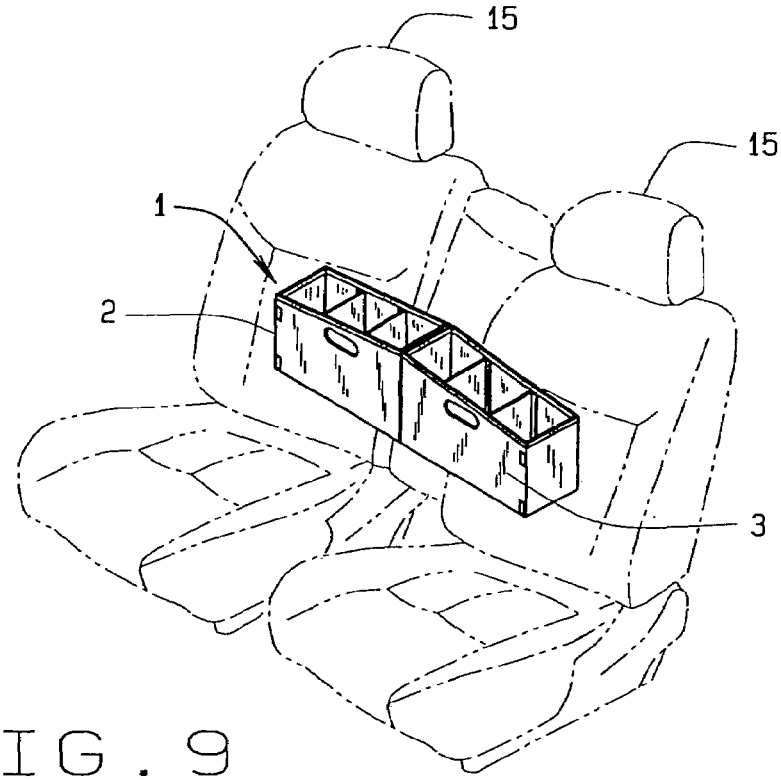
FIG. 9 shows an isometric view of the carrier with wings extended and located behind seats in a vehicle.
Figure 10:
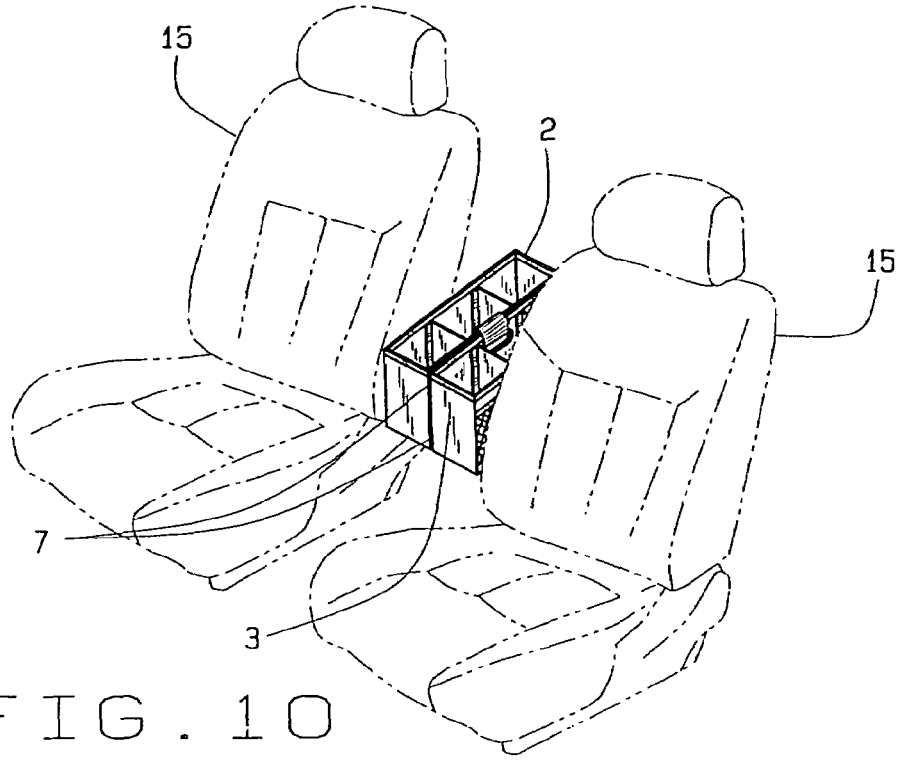
FIG. 10 shows an isometric view of the carrier with wings folded and located between seats in a vehicle; and, FIG. 11 shows an isometric view of the present invention with an alternate feature, the carrying strap.

Reversing FIG. 6, FIG. 7 shows the left wing 2 and the right wing 3 open but with the interior walls 2*e*, 3*e* visible. In this drawing, the left wing 2 is toward the left of the drawing and the right wing 3 is toward the right of the drawing. The strap 4 appears unfolded and detached from the present invention 1 when opened. With the strap 4 away from the present invention 1, the hand holes 12 appear in the center thirds of each wing 2, 3 and in the upper third of the interior walls 2*e*, 3*e*. Where the higher ends 2*c*, 3*c* adjoin, the major fold 6 connects the wings. Opposite the higher ends 2*c*, 3*c*, the lower elevation of each wing 2, 3 has releasable fasteners 7, generally two per wing. The left wing 2 and the right wing 3 have complementary releasable fasteners: hook and loop fasteners in the preferred embodiment.

Figure 8:
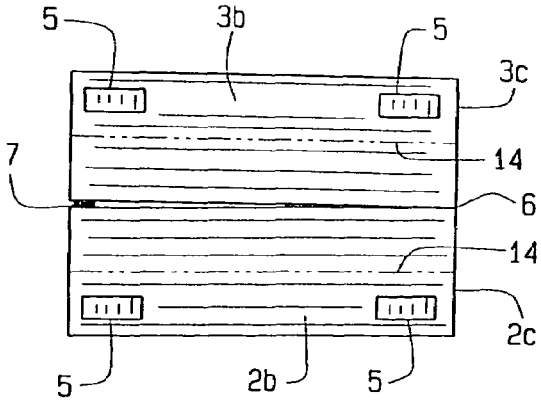
FIG. 8 shows a bottom view of the carrier of the present invention.

Turning over the invention 1, FIG. 8 shows the present invention 1 from beneath. Joined at the major fold 6 upon the higher ends, each wing 2, 3 parallels the other when the invention 1 is closed. On the bottom 2*b*, 3*b*, each wing 2, 3 has two or more feet 5 applied. The feet 5 are near the outer corners of each wing 2, 3 and serve to offset the invention 1 from the ground surface. As previously described, each wing 2, 3 has fold lines 13 on the higher ends and lower ends. The fold lines 14 continue along the bottom 2*b*, 3*b* of each wing 2, 3 which allows the present invention 1 to fold both the bottoms 2*b*, 3*b* and the walls 2*d*, 3*d* inwards.

In use, a user can place the present invention 1 near the front seats 15 of a car. For storage purposes, the user places the present invention 1 with wings 2, 3 unfolded behind the front seats 15. The wings 2, 3 are adjacent to the back of the seats 15 with the hand holes 12 toward the seat 15 and the major fold 6 generally centered between the seats 15. Cords (not shown) extend from the headrest supports to the hand holes 12 and secure the present invention 1 at a desired elevation suitable for access by passengers behind the front seats 15. Also, a user may place the present invention 1 with wings 2, 3 folded together between the front seats 15. The strap 4 through the hand holes 12 is generally centered between the seats 15 and the major fold 6 is located rearward. The present invention 1 is wedged between the front seats 15 at an elevation desired by front seat passengers and out of the way of the driver's arms.

Figure 11:
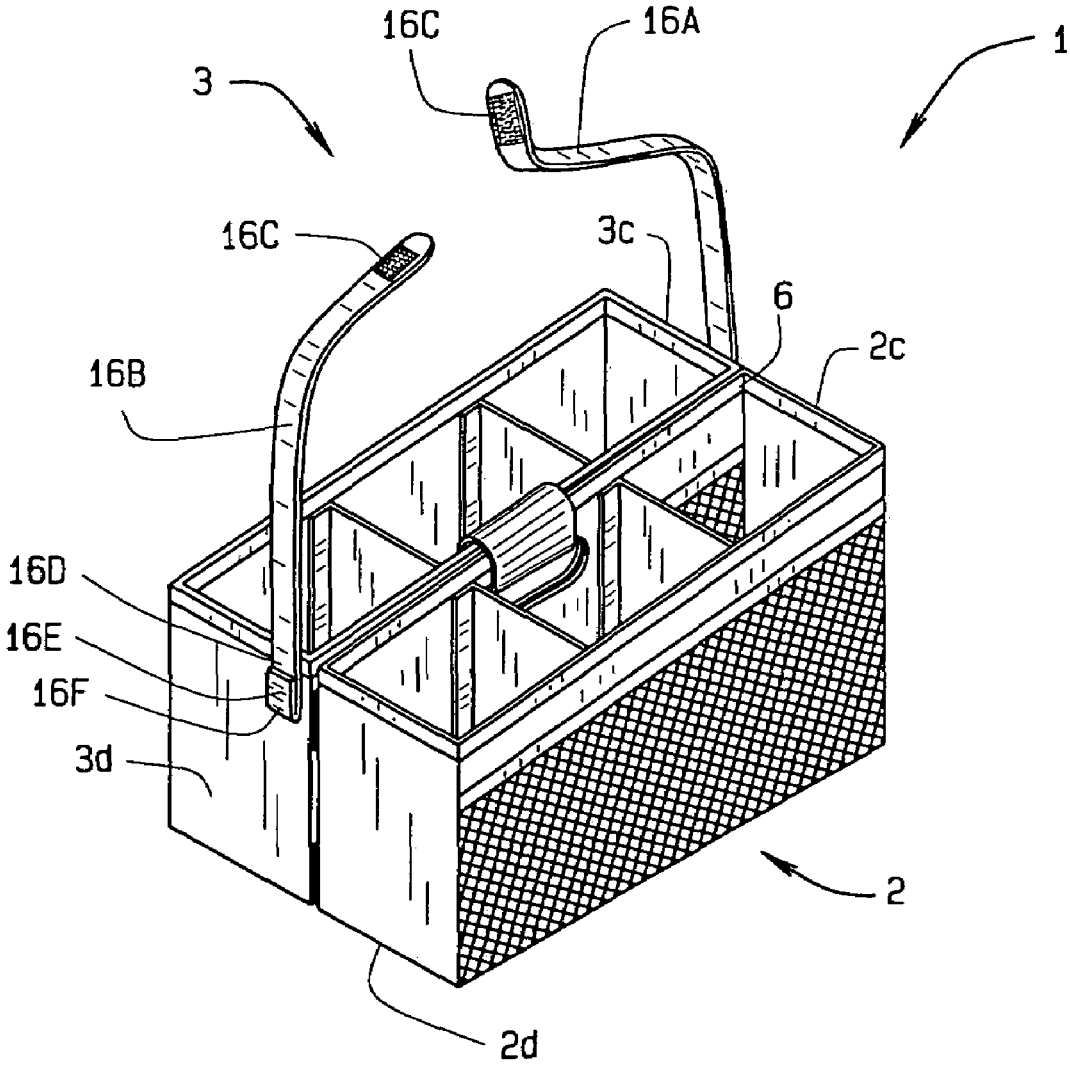

From time to time, a user may desire to take the collapsible carrier and its contents outside of a vehicle. FIG. 11 shows an alternate feature that allows a user to carry the carrier outside of a vehicle: a carrying strap 16 here shown in two sections 16A, 16B. The carrying strap 16 is generally slender but with sufficient width for comfort of the user's shoulder. The rearward section, 16A attaches to the rear of the present invention 1. Generally, the rearward section connects to the higher end 3*c*. Opposite the connection to the higher end, the rearward section 16*a* of the carrying strap has one side of a releasable fastener 16C here shown as hook and loop. On the other end of the carrier 1, the forward section 16B connects to the lower end 3*d*. This connection is spaced apart from the connection of the rearward section 16A and provides both ends with a connection to the strap 16 for balancing. The forward section 16B connects to the front panel 3*d* with a pivotable fastener. Here, the forward section folds over into a loop 16D that encases one side of a ring 16E. The other side of the ring 16E is also encased into a second loop 16F which is joined to the front panel 3*d*. This connection of loops 16D, 16F upon a ring 16E is repeated for the connection of the rearward strap 16A to the rear panel 2*c*. This arrangement of the carrying strap keeps the left wing adjacent to a user while allowing the right wing to open outwards from the user.

Variations or modifications to the subject matter of this invention may occur to those skilled in the art upon reviewing the summary of the invention as defined herein, and upon undertaking a study of the description of its preferred embodiment. Such variations, if within the spirit of this development, are intended to be encompassed within the scope of the invention as shown and described herein. The specific depiction of the invention, as described, and as shown in the drawings, is set forth for illustrative purposes only.

I claim:

1. A collapsible carrier for use within and without a vehicle, comprising:

a left wing having at least one removable divider, an open top, an opposite closed bottom, and two spaced apart lateral ends, and at least two feet upon the bottom;

a right wing having at least one removable divider, an open top, an opposite closed bottom, and two spaced apart lateral ends, at least two feet upon the bottom, and hingedly connecting to the said left wing upon one lateral end; and, a means to releasably connect said left wing to said right wing opposite the hinged connection; and, a strap to releasably connect said left wing to said right wing generally at the center of said carrier;

whereby, said carrier has a closed position where said carrier is compact as left wing is adjacent to said right wing upon a longitudinal side and an open position where said left wing unfolds from the hinged connection to said right wing and said left wing and said right wing are coaxial.

2. The collapsible carrier of claim 1 further comprising:

said right wing having at least one pocket upon the exterior longitudinal wall opposite said left wing;

said right wing having at least one pocket upon the interior longitudinal wall proximate said left wing; and said left wing having at least one pocket subdivided at least one time vertically upon the interior longitudinal wall proximate said right wing.

3. The collapsible carrier of claim 2 wherein said pockets are an open mesh.

4. The collapsible carrier of claim 1 further comprising:

said dividers having a generally planar shape with a flap at each lateral end, said flaps secure to said left wing and to said right wing with hook and loop fasteners.

5. The collapsible carrier of claim 1 further comprising:

said left wing having a generally trapezoidal shape with an end opposite said right wing lower than another end adjacent said right wing, and two mutually parallel and spaced apart walls; and, said right wing having a generally trapezoidal shape with an end opposite said left wing lower than another end adjacent said left wing, and two mutually parallel and spaced apart walls;

whereby in the open position of said carrier the higher lateral ends of both wings are adjacent.

6. The collapsible carrier of claim 1 wherein said connecting means is one of hook and loop fasteners or snap fittings.

7. The collapsible carrier of claim 5 further comprising:

said left wing having a hand hole generally centered upon a wall; and, said right wing having a hand hole generally centered upon a wall.

8. The collapsible carrier of claim 1 further comprising:

a carrying strap, releasably connecting to two spaced apart locations upon one of said wings.

9. The collapsible carrier of claim 8 further comprising:

said carrying strap having a slender and elongate shape and a length reaching from said carrier to the shoulder of a user and back to said carrier.

10. The collapsible carrier of claim 9 further comprising:

said carrying strap connecting generally at said lateral ends of said left wing.

* * * * *